US007207926B2

(12) United States Patent
Hoag

(10) Patent No.: US 7,207,926 B2
(45) Date of Patent: Apr. 24, 2007

(54) DECKLESS TREADMILL SYSTEM

(76) Inventor: Frederick J. Hoag, 150 McLaren Gates Dr., Marietta, GA (US) 30060

( * ) Notice: Subject to any disclaimer, the term of this patent is extended or adjusted under 35 U.S.C. 154(b) by 231 days.

(21) Appl. No.: 10/897,661

(22) Filed: Jul. 22, 2004

(65) Prior Publication Data

US 2006/0019783 A1 Jan. 26, 2006

(51) Int. Cl.
*A63B 22/00* (2006.01)

(52) U.S. Cl. ..... 482/54

(58) Field of Classification Search ..... 482/51, 482/54; 474/148, 206
See application file for complete search history.

(56) References Cited

U.S. PATENT DOCUMENTS

| | | | | |
|---|---|---|---|---|
| 527,722 | A * | 10/1894 | Sargent | 198/698 |
| 3,619,012 | A | 11/1971 | Bizler et al. | |
| 3,643,792 | A * | 2/1972 | Resener | 198/834 |
| 3,650,376 | A | 3/1972 | Burgis et al. | |
| 3,876,089 | A * | 4/1975 | Moser | 414/528 |
| 3,967,721 | A | 7/1976 | Rhoden | |
| 4,280,620 | A | 7/1981 | Baker, Jr. | |
| 4,815,587 | A | 3/1989 | Musil | |
| 5,320,589 | A | 6/1994 | Singleton et al. | |
| 5,385,520 | A | 1/1995 | Lepine et al. | |
| 5,431,613 | A | 7/1995 | Singleton et al. | |
| 5,470,293 | A | 11/1995 | Schonenberger | |
| 5,577,598 | A | 11/1996 | Schoenenberger | |
| 5,738,204 | A | 4/1998 | Baumgartner | |
| 6,146,315 | A | 11/2000 | Schonenberger | |
| 6,348,025 | B1 | 2/2002 | Schonenberger | |
| 2003/0130095 | A1 | 7/2003 | Hellman, Jr. et al. | |

* cited by examiner

*Primary Examiner*—Stephen R. Crow
(74) *Attorney, Agent, or Firm*—Myers & Kaplan, LLC; Ashish D. Patel, Esq.; Barry E. Kaplan, Esq.

(57) ABSTRACT

A deckless treadmill system comprising a cogged-belt in combination with elongated and complementary cogged drive rollers and a series of aligned and cooperatively interactive cogged support rollers disposed proximate to and in cooperative engagement with the peripheral underside edges of the cogged belt. Accordingly, the structural configuration and mechanical componentry of the present invention effectively functions to significantly reduce slip between the elongated cogged drive rollers and the cogged belt, and to further provide the requisite support for the opposing peripheral edges of the cogged belt; thereby, providing a truly deckless treadmill system and overall stable running platform with improved shock absorption and dispersion characteristics. The cogged belt of the present invention is preferably of integral formation or construction and, as such, avoids the structural and mechanical disadvantages and maintenance requirements associated with multilayer or multi-component construction of conventional tread lamellae-and-belt arrangements.

24 Claims, 6 Drawing Sheets

DECKLESS TREADMILL SYSTEM

TECHNICAL FIELD

The present invention relates generally to treadmills and similar fitness equipment, and more specifically to a deckless treadmill system. In addition to enhanced shock absorption and dispersion, the present invention is particularly advantageous in its ability to provide the fitness and health-related benefits customarily associated with conventional deck-based treadmills, without utilization of traditional "cushioned-deck" systems and/or related suspensions systems; thus, lending to the effective elimination of notoriously inconvenient and often expensive deck replacement and/or maintenance requirements typically associated with such available systems.

BACKGROUND OF THE INVENTION

Avid runners, cross-trainers, and the generally health-conscious alike, often take to outdoor running courses or trails as part of a regular cardiovascular fitness training regimen. However, it is overwhelmingly recognized that prolonged periods of excessive running and repetitive high impact strides exerted over concrete or asphalt surfaces, or varied "off-road" terrain, can, and often do, subject the runner to significant joint stress and long-term injury.

More specifically, and as a result of the repetitive joint stress characteristically attributed to the high impact nature of outdoor running, most outdoor runners often develop patellofemoral pain syndrome or "runner's knee," a slow degradation of the medial, and often lateral, menisci of the knee, causative of a mistracking kneecap. In addition thereto, most such runners are further predisposed to a progressive deterioration of the quadricep muscles, the patellar tendon, and/or cartilaginous structures of the ankle and hip joints.

Accordingly, it has been recommended in fitness and health-related literature that outdoor runners run on grass or other soft ground surfaces so as to reduce overall joint stress. Unfortunately, such "softer" ground surfaces may only fractionally reduce joint stress, and, instead, may present unforeseen dips, bumps and/or generally uneven running surfaces likely to contribute to potentially injurious knee-rotation injuries, ankle sprains or ankle twists.

As such, and in an effort to reduce or avoid joint stress and related injuries, many outdoor runners, and runners in general, utilize treadmills as an equally effective and efficient cardiovascular and/or endurance training means. Specifically, most treadmills incorporate a cushioned deck or suspension system over which a treadmill belt is drawn via motors and associated rollers. Although such cushioned decks or suspension systems are intended to absorb and disperse the shock or impact normally transmitted through and absorbed by the runner's ankle, knee and hip joints, the effective ratio of delivered impact to shock absorption is typically insufficient to stave off the above-discussed effects of repetitive joint stress.

Specifically, the cushioned deck of most mass-commercialized treadmills usually consists of a simple pad or cushion disposed over the top surface or impact-receiving area of the deck. Unfortunately, such pads or cushions are typically short-lived, deteriorate over time as a result of impact and stress, thereby contributing to an uneven running surface and, thus, requiring higher maintenance and/or frequent replacement. Although other less commercially available, and often more expensive, deck-based treadmills incorporating suspension systems and shock absorbers, such as springs, rubber bushings or rubber stabilizers, provide some reduction of impact, deck-based treadmills in general present significant disadvantages that render utilization of same highly impractical, inconvenient and expensive.

That is, most deck-based treadmills, typically comprising a deck manufactured from laminated wood or other suitable material, require the regular application of lubricants over the deck surface to reduce the development of friction and heat thereover during use of the treadmill. Accordingly, failure to regularly apply such lubricants over the deck surface typically results in significant structural and mechanical wear to the deck, and rapid belt deterioration. Additionally, development of excessive friction between the belt undersurface and deck surface may cause drag, pulling and/or intermittent and abrupt cessation of belt movement over the deck following delivery of each impacting stride thereon and thereover; thus, resulting in "amp draw", a condition in which excessive strain is placed upon the treadmill motor, thereby effectively drawing power away therefrom and eventually "burning-out" or otherwise damaging same. Moreover, most decks require replacement following wear or deterioration of the laminate or wax surfaces—an often burdensome, time—consuming and expensive process.

In an attempt to avoid the maintenance requirements and/or disadvantages of deck-based treadmills, select treadmill manufacturers have developed various deckless treadmill systems. For instance, some such available systems utilize an endless belt guided around two deflection pulleys, wherein the peripheral underside edges of the belt (or the entire underside of the belt) are toothed and adapted to each engage disk-like toothed rims disposed on opposite ends of a smooth-surfaced deflection pulley. Further, a plurality of tread lamellae are secured to the upper surface of the endless belt, wherein a supporting roller arrangement spans the width of the belt so as to provide a supportive understructure proximate the running area or region of the belt. However, upon operation of such a treadmill system, and in conjunction with the forceful impact delivered with each repetitively striking foot of the runner, an exorbitant amount of noise is often generated from the engagement and subsequent release of the toothed surfaces of the belt from the disk-like toothed rims, rendering use of such a system somewhat objectionable. Further, it is apparent that such treadmill systems are not true deckless systems, as the proper operational dependence and structural integrity of such treadmills largely hinges upon such supporting roller arrangements disposed across and proximate to the running area of the belt.

Accordingly, in an effort to provide a more operationally silent treadmill system, other available deckless systems dispose of the toothed-belt/toothed-rim arrangement entirely, and, instead, simply utilize an endless belt guided around two deflection pulleys, wherein the endless belt also comprises tread lamellae secured thereto. Unfortunately, absent any toothed or similarly notched surface, the otherwise smooth surfaces of each deflection pulley may improperly interact with the otherwise smooth undersurface of the treadmill belt; thereby, resulting in significant slip therebetween, and further affecting the maintenance of parallelism between each individual tread lamella due to inter-lamellae tensile and shear forces. Moreover, although such deckless systems may avoid the application of a supporting roller arrangement disposed under the running area of the belt, no effective support mechanism or structure exists for the opposing peripheral edges of the belt portion disposed between the deflective pulleys; thus, contributing to an excessively flexible or overly forgiving and unstable running surface, and injuries commonly associated therewith (i.e., excessive hyperextension of the knee, and ankle twists or sprains).

Other similar treadmill systems, also utilizing an endless-belt guided around two deflection pulleys, further avoid application of a toothed-belt drive arrangement and, instead, incorporate a system of stabilizers to limit or reduce the occurrence of slip between the driven deflection pulley and the belt, and to further maintain parallel alignment of the individual slats or tread lamellae secured to the belt. That is, each tread lamella of such treadmill systems comprises a stem portion that extends through the belt. During operation of the treadmill, and upon approach of the tread lamellae over the driven deflective pulley, each such stem portion is adapted to be engaged by a configuration of narrow, elongated stabilizers connected to and extending from the shaft of the deflection pulley; thereby, reducing slip between the driven deflection pulley and belt, and further assisting in maintaining the tread lamellae in respective parallel orientation. However, in addition to the recognized structural and functional complexities of such treadmills, as well as the impracticalities and difficulties in the manufacture of same, no effective support mechanism is provided for the opposing peripheral edges of the belt portion disposed between the deflective pulleys; thereby, resulting in the afore-mentioned disadvantages.

Still yet a further disadvantage of the above-described treadmill systems is observed with reference to the structural design and construction of the treadmill belts thereof. That is, such prior art treadmill belts are characterized by a multilayer and multi-component construction, typically comprising a lower belt portion over which a plurality of slats or treadmill lamellae are secured via fastening screws or the like. However, in view of the requirement to maintain parallelism of the treadmill lamellae via complex mechanical arrangements of stabilizers as described above, such multilayer constructions further intensify and contribute to the overall structural and design complexities associated with such treadmill systems. Additionally, such multilayer constructions comprise multiple components (i.e., the plurality of slats or treadmill lamellae, fastening screws, bushings, washers, and the like) that inherently require regular and difficult maintenance and/or replacement upon wear.

Therefore, it is readily apparent that there is a need for a deckless treadmill system that provides the slip-preventative advantages of toothed-belt drive arrangements, yet avoids the complexities inherent in the mechanical and structural design of slip reducing stabilizers. There is a further need for such a deckless treadmill system that effectively provides the requisite support for the opposing peripheral edges of the belt, so as to provide a truly deckless treadmill system and overall stable running platform with improved shock absorption and dispersion characteristics. There is still a further need for such a deckless treadmill system that provides a durable, integrally-formed treadmill belt adapted to provide the requisite structural strength and integrity, and further to effectively absorb and disperse the forceful impact and shock delivered with each repetitively striking foot of the runner.

BRIEF SUMMARY OF THE INVENTION

Briefly described, in a preferred embodiment, the present invention overcomes the above-mentioned disadvantages and meets the recognized need for such a device by providing a deckless treadmill system comprising a cogged-belt in combination with elongated and complementary cogged drive rollers and a series of aligned and cooperatively interactive cogged support rollers disposed proximate to and in cooperative engagement with the peripheral underside edges of the cogged belt. Accordingly, the structural configuration and mechanical componentry of the present invention effectively functions to significantly reduce slip between the elongated cogged drive rollers and the cogged belt, and to further provide the requisite support for the opposing peripheral edges of the cogged belt; thereby, providing a truly deckless treadmill system and overall stable running platform with improved shock absorption and dispersion characteristics. The cogged belt of the present invention is preferably of integral formation or construction and, as such, avoids the structural and mechanical disadvantages and maintenance requirements associated with multilayer or multi-component construction of conventional tread lamellae-and-belt arrangements.

According to its major aspects and broadly stated, the present invention in its preferred form is a deckless treadmill system comprising, in general, an upright support frame and associated user-operation and monitoring console, first and second lower support members, motor and motor housing, forward and rear elongated cogged rollers, a first and second assembly or series of smaller cogged support rollers, and an endless cogged belt.

More specifically, the present invention is a deckless treadmill system comprising first and second lower support members in secured communication with an upright support frame, or, alternatively, in substantially pivotal engagement with a motor housing, thereby providing the popular space-saving construction of available treadmill systems. A programming console is further preferably disposed on and supported by the upright support frame, as is known within the art. Preferably disposed between and supported by the first and second lower support members are forward and rear elongated cogged rollers, wherein the forward cogged roller is preferably in further communication with and operatively driven by a treadmill motor disposed with the motor housing.

Of particular importance, the forward and rear elongated cogged rollers are each structurally and functionally characterized by a plurality of aligned and equally-spaced elongated cogs disposed across the full width of each respective roller and oriented parallel to the rotational axis thereof.

Preferably secured to the respective inner surfaces of first and second lower support members is a first and second series of smaller, relatively flat or disc-like cogged support rollers, each such series being operatively maintained within support brackets, and generally disposed between the co-terminal ends of the respective elongated cogged rollers. Accordingly, each such cogged support roller preferably comprises a rotational axis parallel to the rotational axis of the elongated cogged rollers. Moreover, each cogged support roller further comprises an arrangement or spacing of cogs equivalent or complimentary to the arrangement or spacing of cogs disposed over the elongated cogged rollers; thus, enabling the cooperative engagement of an endless belt therewith.

Accordingly, an endless cogged belt, preferably comprising a cogged underside complementary to the cogged surfaces of the elongated cogged rollers, and, as such, the cogged periphery of each cogged support roller, is preferably disposed around and cooperatively engaged with the contacting cogs of each elongated cogged roller. Additionally, as the first and second opposing peripheral edges of the belt are disposed proximate to the inner surfaces of respective first and second lower support members, first and second series of cogged support rollers, respectively, also preferably cooperatively engage the cogged underside of the belt, and more specifically, the opposing peripheral underside edges thereof. As such, as the belt is guided around the elongated cogged rollers, each smaller cogged support roller preferably interactively, and in cooperative harmony or unison, assists in supporting and propelling the endless belt through its fixed rotational path. Importantly, the first and second series of cogged support rollers provide the requisite support for the opposing peripheral edges of the cogged belt; thereby, providing a truly deckless treadmill system and overall stable running platform with improved shock absorption and dispersion characteristics.

Preferably, the endless belt of the present invention is manufactured from a durable, yet pliable, rubber substrate substantially resistive to the degradative effects of heat and friction. Most notably, the belt of the present invention further comprises elongated, T-shaped cross-sectional support beams or slats, each integrally formed with, enclosed within, and extending through, the full width of a respective cog formed on the underside of the belt, wherein each such slat is preferably formed from a resilient metal comprising a high degree of tensile and yield strength. In such a configuration, the endless belt hereof is of substantially uniform construction and effectively provides a durable, stable and supportive running platform, without the structural and mechanical disadvantages and maintenance requirements associated with the multilayer or multi-component construction characteristic of conventional tread lamellae-and-belt arrangements.

Accordingly, a feature and advantage of the present invention is its ability to provide a deckless treadmill system comprising a cogged-belt in combination with elongated and complementary cogged drive rollers and a series of strategically aligned and cooperatively interactive cogged support rollers.

Another feature and advantage of the present invention is its ability to provide elongated cogged rollers comprising elongated cogs disposed over the widths thereof, wherein such an arrangement of cogs, in conjunction with the cooperative interaction of same with the cogged belt, significantly reduces the occurrence of slip therebetween.

Still another feature and advantage of the present invention is its ability to provide the requisite support for the opposing peripheral edges of the cogged belt; thereby, providing a truly deckless treadmill system and overall stable running platform with improved shock absorption and dispersion characteristics.

Yet another feature and advantage of the present invention is its provision of smaller cogged support rollers, which, in conjunction with the elongated cogged rollers, preferably interactively, and in cooperative harmony or unison, assist in supporting and propelling the endless belt through its fixed rotational path.

Still yet another feature and advantage of the present invention is its ability to provide an endless belt of substantially uniform construction, wherein integrally formed and internally disposed T-shaped cross-sectional support beams or slats provide a durable, stable and supportive running platform.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

Figure 1:
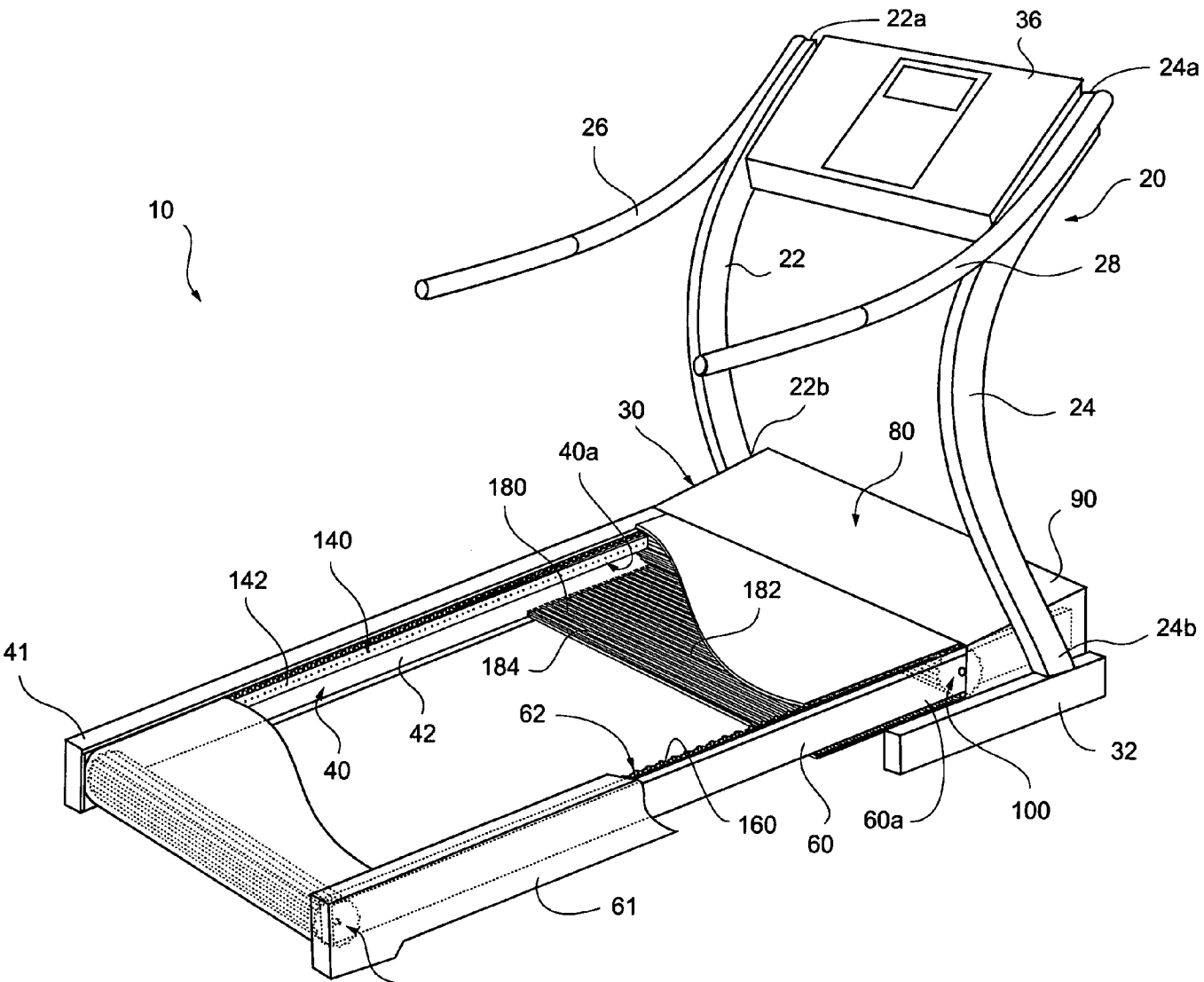
FIG. 1 is a partial cutaway and perspective view of a deckless treadmill system according to a preferred embodiment of the present invention.

In describing the preferred and selected alternate embodiments of the present invention, as illustrated in FIGS. 1–6A, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1–5, the present invention in a preferred embodiment is a deckless treadmill system 10 comprising upright support frame 20, programming console 36, first lower support member 40, second lower support member 60, motor 80 and motor housing 90, forward elongated cogged roller 100, rearward elongated cogged roller 120, first series of cogged support rollers 140, second series of cogged support rollers 160, and endless cogged belt 180.

Referring now more specifically to FIG. 1, upright support frame 20 comprises a structure and fabrication substantially equivalent to that of conventional treadmill structures, preferably including upright support legs 22, 24, wherein hand rails 26, 28 are preferably secured to and extend substantially perpendicularly from upper ends 22*a*, 24*a* of respective support legs 22, 24, and wherein stabilizing or support feet 30, 32 are preferably secured to and extend substantially perpendicularly from lower ends 22*b*, 24*b* of respective support legs 22, 24. Programming console 36 is further preferably disposed between and supported by upper ends 22*a*, 24*a* of respective upright support legs 22, 24, as is known within the art, and further provides the traditional operational features and controls for treadmill system 10. Upright support frame 20 is preferably fabricated from a durable and sturdy metal, such as, for exemplary purposes only, steel, galvanized metals, aluminum, titanium, or the like; however, other suitable non-metal substrates may also be utilized, such as polycarbonates, structural composites, or the like.

Preferably mounted between support feet 30, 32 of upright support frame 20 is motor housing 90, comprising treadmill motor 80 operatively disposed and mounted therewithin. Treadmill motor 80 is preferably any selected conventional treadmill motor, including, without limitation, fixed or variable speed alternating current motors, direct current motors, and/or motors adapted to provide continuous horsepower.

Figure 2:
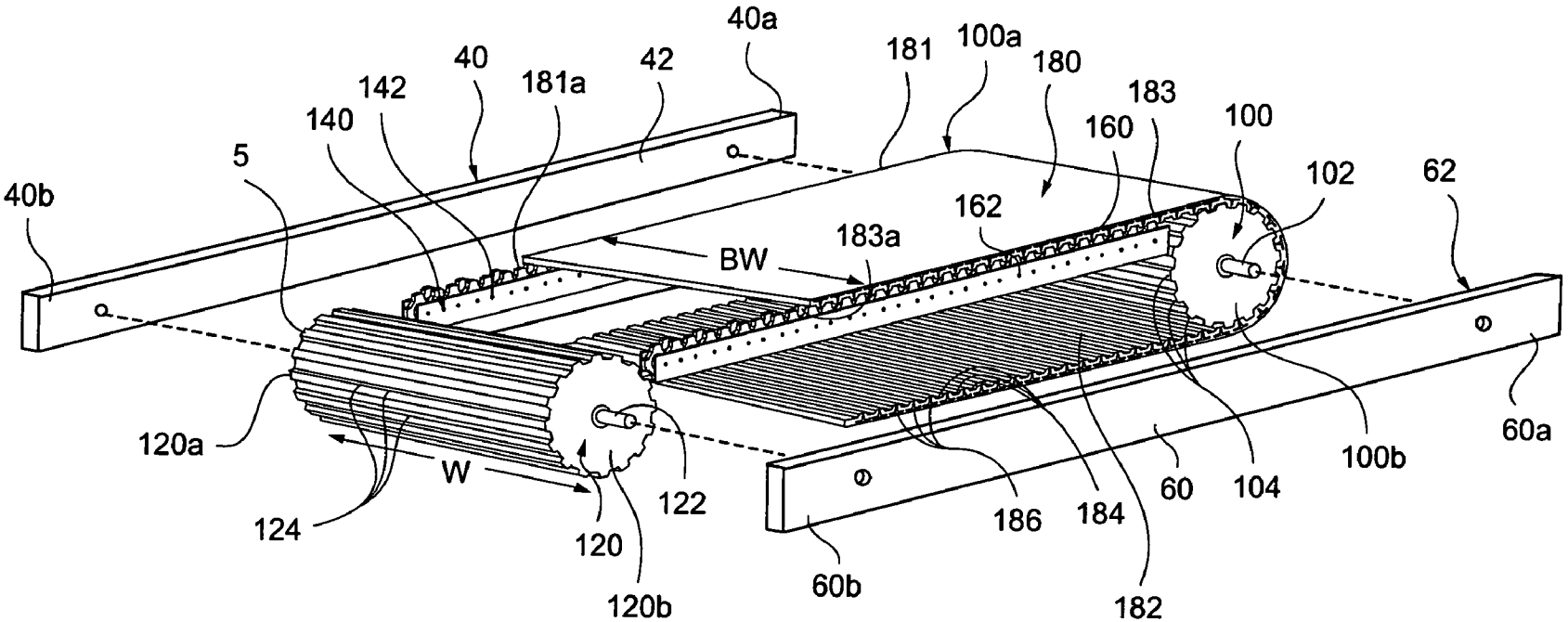
FIG. 2 is a partial cutaway and perspective view of a belt, elongated cogged rollers, and cogged support rollers of a deckless treadmill system according to a preferred embodiment of the present invention.

Referring now more specifically to FIG. 2, and with continued reference to FIG. 1, lower support members 40 and 60 preferably provide a supportive lower framework onto which elongated cogged rollers 100, 120, cogged support rollers 140, 160, and endless cogged belt 180 are strategically and functionally disposed and configured so as to provide the deckless running surface of the present invention. Accordingly, forward ends 40*a*, 60*a* of respective first and second lower support members 40, 60, are in secured communication with support feet 30, 32 of upright support frame 20, or, alternatively, in substantially pivotal engagement therewith or with motor housing 90; thereby, permitting lower support members 40, 60, and communicating elongated cogged rollers 100, 120, cogged support rollers 140, 160, and belt 180, to pivot into a substantially upright position; thus, providing the popular space-saving construction of many available treadmill systems. Moreover, lower support members 40, 60 are preferably secured to and elevated by external housings 41, 61, respectively; thereby, maintaining elongated cogged rollers 100, 120, cogged support rollers 140, 160, and communicating belt 180, a sufficient distance from the floor surface so as to avoid contact therewith and, thus, promoting uninterrupted rotational movement of belt 180. Additionally, external housings 41, 61 assist in guarding or shielding cogged rollers 100, 120, and cogged support rollers 140, 160, from view and/or accidental contact.

Preferably suspended between and supported by lower support members 40, 60 are forward and rearward elongated cogged rollers 100, 120, respectively. More specifically, axle 102 of forward cogged roller 100 is preferably pivotally engaged between inner surfaces 42, 62 of first and second lower support members 40, 60, proximal forward ends 40*a*, 60*a*, respectively, thereof. Similarly, axle 122 of rear cogged roller 120 is preferably pivotally engaged between inner surfaces 42, 62 of first and second lower support members 40 and 60, proximal rear ends 40*b*, 60*b*, respectively, thereof. Additionally, forward cogged roller 100 is preferably in further communication with and operatively driven by treadmill motor 80 via conventional drive belt systems or like. Although rear cogged roller is operatively and rotational responsive to driven forward cogged roller 100, it should be recognized that rear cogged roller 120 may also be driven via a communicating or shared drive belt system or like.

Forward and rearward elongated cogged rollers 100, 120, respectively, are each structurally and functionally characterized by a plurality of aligned and equally-spaced elongated cogs 104, 124 disposed over the entire surface S and full width W of each respective roller 100, 120, and further preferably oriented parallel to respective axles 102, 104, and, thus, the rotational axis of each respective roller 100, 120. Elongated cogged rollers 100, 120 are each preferably molded, formed or otherwise manufactured from a durable substrate, such as, for exemplary purposes only, polycarbonate, plastic, metal, structural composites, or other suitable substrates.

Figure 3:
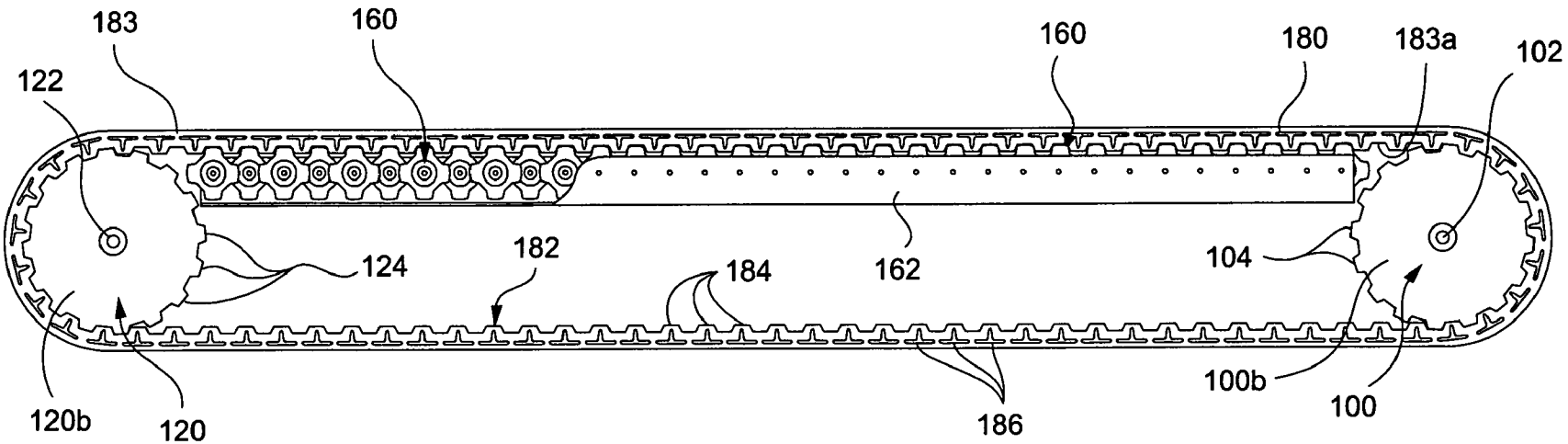
FIG. 3 is a partial cutaway and side view of a belt, elongated cogged rollers, and cogged support rollers of a deckless treadmill system according to a preferred embodiment of the present invention.
Figure 4:
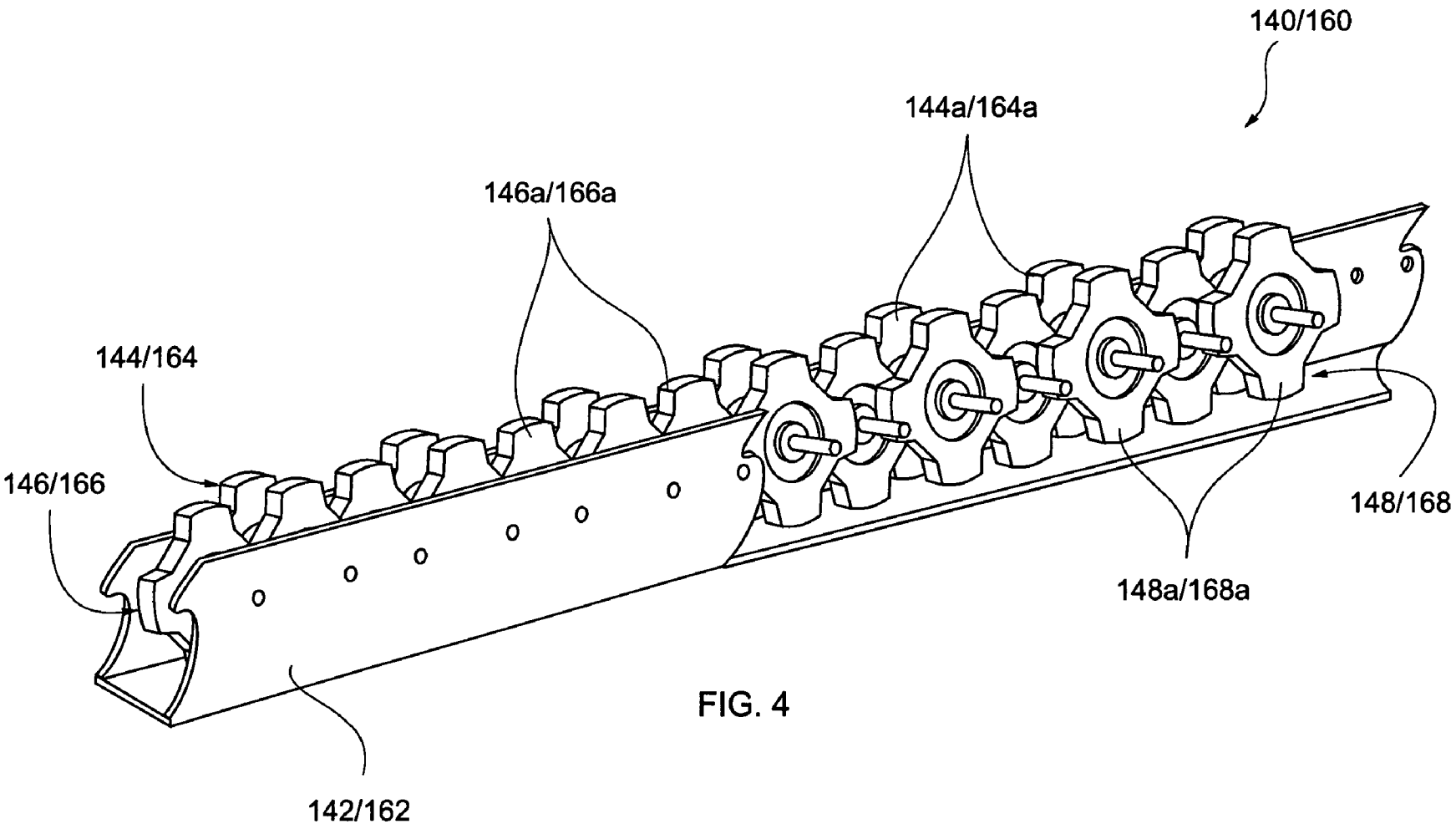
FIG. 4 is a partial cutaway and perspective view of a series of cogged support rollers of a deckless treadmill system according to a preferred embodiment of the present invention.
Figure 5:
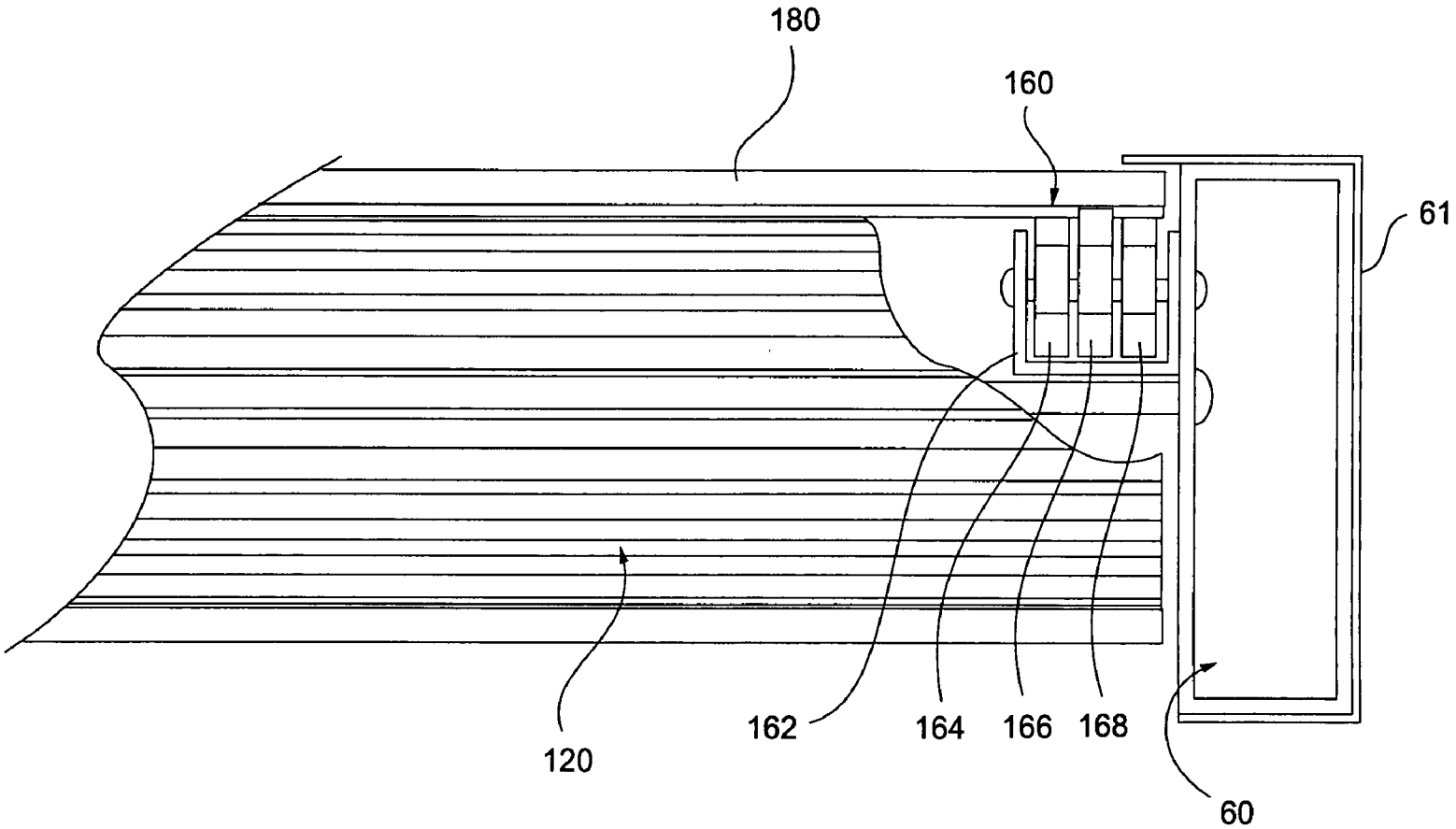
FIG. 5 is a partial cutaway and end view of a series of cogged support rollers of a deckless treadmill system according to a preferred embodiment of the present invention.

As best illustrated in FIGS. 3–5, and with continued reference to FIGS. 1–2, preferably secured to respective inner surfaces 42, 62 of first and second lower support members 40, 60 are generally U-shaped support troughs or brackets 142, 162, respectively, wherein brackets 142, 162 preferably operatively and rotatably maintain therewithin respective first and second series of smaller, relatively flat or disc-like cogged support rollers 140, 160. Specifically, bracket 142, and associated cogged support rollers 140, preferably substantially extends the length of lower support member 40, extending between and proximate to terminal ends 100*a*, 120*a* of respective elongated cogged rollers 100, 120. Similarly, bracket 162, and associated cogged support rollers 160, preferably substantially extends the length of lower support member 60, extending between and proximate to terminal ends 100*b*, 120*b* of respective elongated cogged rollers 100, 120.

Referring now more specifically to FIGS. 4–5, brackets 142, 162, and associated cogged support rollers 140, 160, respectively, are of equivalent design, structure and configuration. Specifically, first series of cogged support rollers 140 is rotatably mounted within bracket 142 and preferably arranged in adjacently disposed first, second and third rows 144, 146, 148, respectively. Preferably, each individual cogged support roller 144*a* disposed within first row 144 of series 140, is preferably opposingly aligned with an individual cogged support roller 148*a* disposed within third row 148. However, each individual cogged support roller 146*a* disposed within second row 146 of series 140, is preferably disposed substantially after each opposingly aligned set of cogged support rollers 144*a*, 148*a* of respective rows 144, 148, in a linearly staggered relationship.

Similarly, second series of cogged support rollers 160 is rotatably mounted within bracket 162 and preferably arranged in adjacently disposed first, second and third rows 164, 166, 168, respectively. Each individual cogged support roller 164*a* disposed within first row 164 of series 160, is similarly opposingly aligned with an individual cogged support roller 168*a* disposed within third row 168. Moreover, each individual cogged support roller 166*a* disposed within second row 166 of series 160, is likewise preferably disposed substantially after each opposingly aligned set of cogged support rollers 164*a*, 168*a* of respective rows 164, 168, in a linearly staggered relationship.

Preferably, and as more fully described below, the foregoing configuration of cogged support rollers 140, 160 is designed to provide a stable and supportive surface area over which belt 180 may be continuously guided and propelled through its rotational cycle; however, it should be recognized that any alternate configuration and/or number of cogged support rollers and/or rows of cogged support rollers could be utilized to effectively assist in supporting and stabilizing belt 180.

Preferably, cogged support rollers 144*a*, 146*a*, 148*a*, 164*a*, 166*a*, 168*a* comprise rotational axes parallel to the rotational axis of elongated cogged rollers 100, 120. Moreover, the arrangement or spacing of cogs disposed around the outer peripheral edge of each cogged support roller 144*a*, 146*a*, 148*a*, 164*a*, 166*a*, 168*a* is equivalent or complimentary to the arrangement or spacing of cogs 104, 124 disposed over elongated cogged rollers 100, 120. Each cogged support roller 144*a*, 146*a*, 148*a*, 164*a*, 166*a*, 168*a* is preferably molded and manufactured from a durable substrate, such as, for exemplary purposes only, polycarbonate, plastic, metal, structural composites, or other suitable substrates.

Referring now more specifically to FIGS. 2–3, and with continued reference to FIG. 1, endless cogged belt 180 preferably comprises underside 182 characterized by a plurality of aligned and elongated cogs 184 dimensionally complementary to cogs 104, 124 of elongated cogged rollers 100, 120, and, as such, the cogged periphery of each cogged support roller 144*a*, 146*a*, 148*a*, 164*a*, 166*a*, 168*a*. Preferably, elongated cogs 184 of belt 180 span full width BW thereof. Accordingly, belt 180 is preferably disposed around, tensioned, and cooperatively engaged with contacting cogs 104, 124 of each elongated cogged roller 100, 120. Additionally, as opposing peripheral edges 181, 183 of belt 180 are disposed proximate to inner surfaces 42, 62 of respective first and second lower support members 40, 60, first and second series of cogged support rollers 140, 160, respectively, also preferably cooperatively engage elongated cogs 184 disposed on underside 182 of belt 180, and more specifically, the portion or region of elongated cogs 184 formed along peripheral underside edges 181*a*, 183*a* of belt 180.

As such, as belt 180 is guided around elongated cogged rollers 100, 120, each smaller cogged support roller 144*a*, 146*a*, 148*a*, 164*a*, 166*a*, 168*a* preferably interactively, and in cooperative harmony or unison, assists in supporting and propelling endless cogged belt 180 through its fixed rotational path. Most importantly, cogged support rollers 144*a*, 146*a*, 148*a*, 164*a*, 166*a*, 168*a* of respective first and second series of cogged support rollers 140, 160 collectively provide the requisite support for opposing peripheral edges 181, 183 of cogged belt 180; thereby, providing a truly deckless treadmill system and overall stable running surface.

With specific reference to FIGS. 2–3, endless cogged belt 180 is preferably manufactured from a durable, yet pliable, rubber substrate substantially resistive to the degradative effects of heat and friction. Additionally, belt 180 preferably comprises a plurality of elongated support beams or slats 186 comprising a T-shaped cross-section, wherein each such slat 186 is preferably integrally formed with, enclosed within, and extends substantially through the width of a respective cog 184 formed on underside 182 of belt 180. Each slat 186 is preferably formed from a resilient metal comprising a high degree of tensile and yield strength, such as, for exemplary purposes only, aluminum, titanium, metal alloys, structural composites, and the like; thereby, enhancing the supportive, impact receiving and load bearing characteristics of belt 180. The preferred T-shaped cross-section of each slat 186 further provides belt 180 with significant impact or load bearing and receiving attributes. Accordingly, the preferred method of fabrication of cogged belt 180 provides a durable, stable and supportive running surface of substantially uniform construction.

It is contemplated in an alternate embodiment that the deckless treadmill technology of the present invention could be applied to other similar fitness training machines, such as, for exemplary purposes only, combination treadmill-and-stair-climbing fitness machines, manual treadmill systems, and the like.

It is contemplated in another alternate embodiment that cogged guide rollers may be positioned on lower support members 40, 60 such that the cogged guide rollers cooperatively and interactively engage the belt portion running closest to the ground surface. In such a configuration, it is contemplated that the cogged guide rollers would be positioned below cogged support rollers 140, 160.

It is contemplated in still another alternate embodiment that cogged support rollers 144*a*, 146*a*, 148*a*, 164*a*, 166*a*, 168*a* could comprises a diameter equivalent to the diameter of elongated cogged rollers 100, 120, yet maintain an overall disk-like shape. In such a configuration, cogged support rollers 144*a*, 146*a*, 148*a*, 164*a*, 166*a*, 168*a* could remain in cooperative and interactive engagement with all cogs 184 of belt 180 at all times. A variation of the present alternate embodiment further contemplates single, juxtaposingly-positioned cogged support rollers, as opposed to rows of same, as described above.

It is contemplated in still another alternate embodiment that terminal ends 100*a*, 100*b*, 120*a*, 120*b* of elongated cogged rollers 100, 120 could comprise disks or plates secured thereto and/or integrally formed therewith, wherein the disks or plates could comprise a diameter slightly larger than the diameter of cogged rollers 140, 160. Accordingly, the disks or plates could effectively serve as alignment walls within which belt 180 could be maintained in a substantially aligned rotational path, and in effective engagement with cogged rollers 100, 120, and first and second series of cogged support rollers 140, 160, respectively. However, it should be recognized that conventional belt alignment systems may alternatively be utilized.

It is contemplated in still yet another alternate embodiment that elongated cogged rollers 100, 120 could be manufactured so as to comprise smooth peripheral margins formed at respective opposing terminal ends 100*a*, 100*b*, and 120*a*, 120*b* thereof (i.e., so that respective elongated cogs 104, 124 stop just short thereof).

Figure 6:
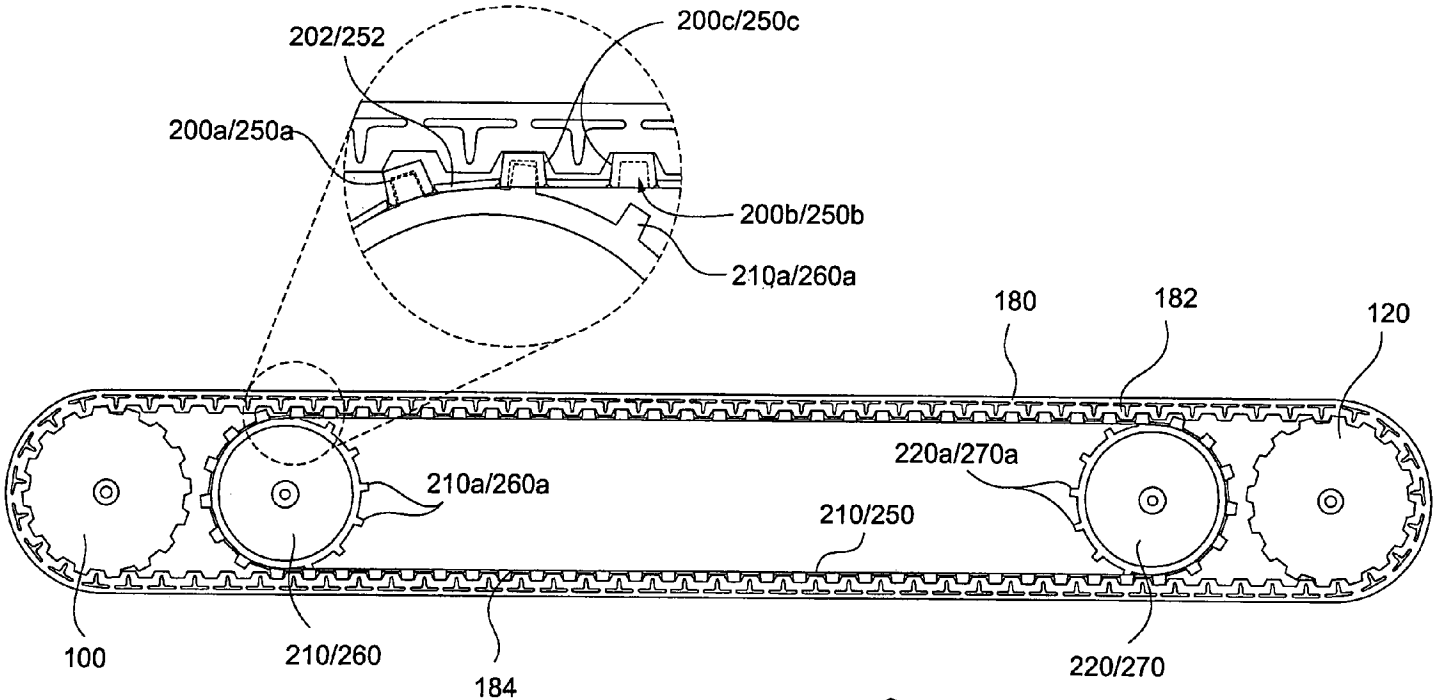
FIG. 6 is a side view of a belt, elongated cogged rollers, cogged plates and endless support chain of a deckless treadmill system according to an alternate embodiment of the present invention; and, FIG. 6A is a partial peripheral view of a cogged plate and endless support chain of a deckless treadmill system according to an alternate embodiment of the present invention.
Figure 6A:
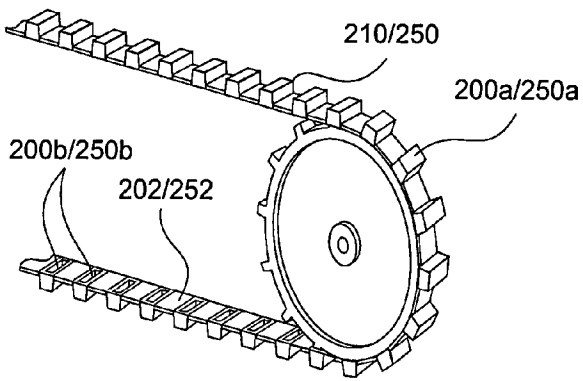

Referring now more specifically to FIGS. 6–6A, illustrated therein is an alternate embodiment of deckless treadmill system 10, wherein the alternate embodiment of FIGS. 6–6A is substantially equivalent in form and function to that of the preferred embodiment detailed and illustrated in FIGS. 1–5 except as hereinafter specifically referenced. Specifically, the embodiment of FIGS. 6–6A replaces brackets 142, 162, and associated cogged support rollers 140, 160, with endless support chain 200, 250, respectively, wherein endless support chain 200 is cooperatively engaged and tensioned around cogged plates 210, 220, and wherein endless support chain 250 is cooperatively engaged and tensioned around cogged plates 260, 270. For clarity, FIGS. 6–6A illustrate both endless support chain 200, 250, cogged plates 210, 220, 260, 270, and all associated elements thereof, as hereinafter described. Each cog 200*a*, 250*a* of respective endless chains 200, 250 comprises pocket or recess 200*b*, 250*b*, respectively, wherein recesses 200*b*, 250*b* are dimensioned to receive cogs 210*a*, 220*a*, 260*a*, 270*a*, respectively, formed around respective cogged plates 210, 220, 260, 270, and thus, remain interactively engaged therewith during movement of chains 200, 250 through a propelled and fixed rotational path, as more fully described below. Cogged plates 210, 220, 260, 270 are disposed between respective elongated cogged rollers 100, 120, and are similarly rotatably mounted to inner surfaces 42, 62 of respective first and second lower support members 40, 60 of treadmill system 10.

Cogs 200*a*, 250*a* of respective endless chains 200, 250 are pivotally engaged together via hinge plates 202, 252, respectively, wherein hinge plates 202, 252 are characterized by an angularly limited range of motion. As such, endless chains 200, 250 may pivotally bend or wrap around respective cogged plates 210, 220, 260, 270; however, due to the angularly limited range of motion of hinge plates 202, 252, chains 200, 250 resist inward depression. That is, as downward pressure/force is applied to chains 200, 250, sidewalls 200*c*, 250*c* of each respective cog 200*a*, 250*a* of respective endless chains 200, 250, lockingly contact or abut against respective hinge plates 202, 252, thereby creating a temporarily rigid area or length along chains 200, 250. As more fully described below, this temporarily rigid area or length along chains 200, 250 provides the requisite support for opposing peripheral edges 181, 183 of cogged belt 180.

Each cog 200*a*, 250*a* of respective endless chains 200, 250 is complementary to elongated cogs 184 formed on underside 182 of belt 180. Accordingly, cogs 200*a*, 250*a* of respective endless chains 200, 250 are structurally adapted to cooperatively engage cogged underside 182 of belt 180, and thus, be interactively, and in cooperative harmony or unison, propelled with belt 180 through its fixed rotational path. Moreover, as endless chains 200, 250, and associated cogged plates 210, 220, 260, 270, are disposed along respective inner surfaces 42, 62 of respective first and second lower support members 40, 60, endless chains 200, 250 are cooperatively engaged with the portion or region of elongated cogs 184 formed along peripheral underside edges 181*a*, 183*a* of belt 180; thus, providing the requisite support for opposing peripheral edges 181, 183 of cogged belt 180.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A deckless treadmill system, comprising:

a first elongated roller comprising a first end and a second end, wherein a plurality of elongated cogs are disposed about the periphery thereof and extend substantially from said first end to said second end; a second roller;

a plurality of support rollers, each comprising a cogged peripheral edge; and an endless belt comprising a top side and an underside, said underside comprising a plurality of elongated cogs extending substantially from a first peripheral edge to an opposing second peripheral edge of said endless belt.

2. The deckless treadmill system of claim 1, wherein said second roller is an elongated roler comprising a first end and a second end, wherein a plurality of elongated cogs are disposed about the periphery thereof and extend substantially from said first end to said second end of said second elongated roller.

3. The deckless treadmill system of claim 2, wherein said first and said second elongated rollers comprise parallel axes of rotation, and wherein said plurality of elongated cogs of said first and said second elongated rollers are disposed parallel to said axes of rotation.

4. The deckless treadmill system of claim 3, wherein said plurality of support rollers comprise axes of rotation disposed parallel to said axes of rotation of said first and said second elongated rollers.

5. The deckless treadmill system of claim 3, wherein said endless belt is disposed around, tensioned and cooperatively engaged with first and said second elongated rollers.

6. The deckless treadmill system of claim 3, wherein said endless belt is disposed around and cooperatively engaged with said plurality of support rollers.

7. The deckless treadmill system of claim 3, wherein said plurality of elongated cogs of said endless belt are cooperatively and interactively engaged with said plurality of elongated cogs of said first and said second elongated rollers.

8. The deckless treadmill system of claim 3, wherein said plurality of elongated cogs of said endless belt are cooperatively and interactively engaged with said cogged peripheral edges of said plurality of support rollers.

9. The deckless treadmill system of claim 2, wherein said plurality of support rollers are disk-like.

10. The deckless treadmill system of claim 9, wherein said plurality of support rollers are at least partially surrounded by said endless belt, and disposed proximate to opposing said first and second peripheral edges thereof.

11. The deckless treadmill system of claim 10, wherein a portion of said plurality of elongated cogs of said endless belt disposed along said underside of said endless belt, proximate to said first and second peripheral edges thereof, are cooperatively and interactively engaged with said cogged peripheral edges of said plurality of support rollers.

12. The deckless treadmill system of claim 11, wherein said plurality of support rollers interactively, and in cooperative harmony, assist in supporting and propelling said endless belt through a fixed rotational path.

13. The deckless treadmill system of claim 11, wherein said plurality of support rollers collectively provide support for said first and second peripheral edges of said endless belt.

14. The deckless treadmill system of claim 1, wherein said endless belt is formed from a durable, yet pliable, substrate.

15. The deckless treadmill system of claim 14, wherein said endless belt comprises a plurality of elongated support beams or slats.

16. The deckless treadmill system of claim 15, wherein each said elongated support beam or slat comprises a T-shaped cross-section.

17. The deckless treadmill system of claim 16, wherein each said elongated support beam or slat is integrally formed with a cog of said plurality of cogs formed on said underside of said endless belt.

18. The deckless treadmill system of claim 16, wherein each said elongated support beam or slat is integrally formed with and extends substantially through a cog of said plurality of cogs formed on said underside of said endless belt.

19. A deckless treadmill system, comprising:

an endless cogged belt in cooperative engagement with elongated and complementary cogged drive rollers and a series of cogged support rollers, said series of cogged support rollers disposed proximate to and in cooperative engagement with opposing first and second peripheral underside edges of said cogged belt, wherein said cogged support rollers collectively provide support for said opposing first and second peripheral underside edges of said endless cogged belt.

20. The deckles treadmill system of claim 19, wherein a first said series of cogged support rollers are disposed proximate to said first peripheral underside edge of said cogged belt, and wherein a second said series of cogged support rollers are disposed proximate to said second peripheral underside edge of said cogged belt.

21. The deckles treadmill system of claim 19, wherein said series of cogged support rollers comprises a first row of cogged support rollers and a second row of cogged support rollers.

22. The deckles treadmill system of claim 21, wherein said series of cogged support rollers comprises a third row of cogged support rollers.

23. The deckles treadmill system of claim 22, wherein each cogged support roller of said first row of cogged support rollers is opposingly aligned with a cogged support roller of said third row of cogged support rollers.

24. The deckles treadmill system of claim 22, wherein each cogged support roller of said second row is staggered between each opposingly aligned said cogged support rollers of said first and said second rows of cogged support rollers.

* * * * *